US009334742B2

(12) United States Patent
Zhang et al.

(10) Patent No.: US 9,334,742 B2
(45) Date of Patent: May 10, 2016

(54) ROTOR BLADE AND METHOD FOR COOLING THE ROTOR BLADE

(71) Applicant: General Electric Company, Schenectady, NY (US)

(72) Inventors: Xiuzhang James Zhang, Simpsonville, SC (US); Adebukola Benson, Simpsonville, SC (US); Zhirui Dong, Simpsonville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 833 days.

(21) Appl. No.: 13/645,585

(22) Filed: Oct. 5, 2012

(65) Prior Publication Data

US 2014/0099193 A1 Apr. 10, 2014

(51) Int. Cl.
*F01D 5/00* (2006.01)
*F01D 5/20* (2006.01)

(52) U.S. Cl.
CPC ..... *F01D 5/20* (2013.01)

(58) Field of Classification Search
CPC ..... F01D 5/20; F01D 5/187; F01D 5/18; F01D 5/225
USPC ..... 415/173.6
See application file for complete search history.

(56) References Cited

U.S. PATENT DOCUMENTS 4,606,701 A * 8/1986 McClay et al. ..... 416/92
5,733,102 A 3/1998 Lee et al.
5,927,946 A * 7/1999 Lee ..... F01D 5/187 415/115
5,997,251 A 12/1999 Lee
6,027,306 A * 2/2000 Bunker ..... 415/173.5
6,254,345 B1 * 7/2001 Harris et al. ..... 416/96 R
6,652,235 B1 11/2003 Keith et al.
7,513,743 B2 4/2009 Liang
8,083,484 B2 * 12/2011 Hatman ..... 416/92
8,157,504 B2 4/2012 Amaral et al.
8,337,158 B1 * 12/2012 Liang ..... 416/97 R
8,801,377 B1 * 8/2014 Liang ..... 416/97 R
9,045,988 B2 * 6/2015 Mishra et al.
2002/0094268 A1 * 7/2002 Sugishita ..... F01D 9/04 415/139
2002/0162220 A1 11/2002 Updegrove et al.
2006/0171809 A1 8/2006 Albrecht et al.
2010/0232979 A1 9/2010 Paauwe et al.
2013/0039773 A1 * 2/2013 Funk et al. ..... 416/223 R

OTHER PUBLICATIONS

EP Search Report and Written Opinion dated Nov. 26, 2013, issued in connection with corresponding EP Patent Application No. 13187418.2.

* cited by examiner

*Primary Examiner* — Craig Kim
*Assistant Examiner* — Jason Fountain
(74) *Attorney, Agent, or Firm* — Dority & Manning, PA

(57) ABSTRACT

A rotor blade includes an airfoil having a tip plate that extends across an outer radial end. A rim extends radially outward from the tip plate and surrounds at least a portion of the airfoil and includes a concave portion opposed to a convex portion. A plurality of dividers extend between the concave and convex portions to define a plurality of pockets between the concave and convex portions at the outer radial end. A plurality of cooling passages through the tip plate provide fluid communication through the tip plate to the plurality of pockets. A first fluid passage in at least one divider provides fluid communication between adjacent pockets across the at least one divider.

17 Claims, 7 Drawing Sheets

ROTOR BLADE AND METHOD FOR COOLING THE ROTOR BLADE

FIELD OF THE INVENTION

The present invention generally involves a rotor blade and a method for cooling the rotor blade.

BACKGROUND OF THE INVENTION

Turbines are widely used in industrial and commercial operations. A typical commercial steam or gas turbine used to generate electrical power includes alternating stages of stationary and rotating airfoils or blades. For example, stator vanes may be attached to a stationary component such as a casing that surrounds the turbine, and rotor blades may be attached to a rotor located along an axial centerline of the turbine. A compressed working fluid, such as but not limited to steam, combustion gases, or air, flows through the turbine, and the stator vanes accelerate and direct the compressed working fluid onto the subsequent stage of rotor blades to impart motion to the rotor blades, thus turning the rotor and performing work.

Compressed working fluid that leaks around or bypasses the rotor blades reduces the efficiency of the turbine. To reduce the amount of compressed working fluid that bypasses the rotor blades, the casing may include stationary shroud segments that surround each stage of rotor blades, and each rotor blade may include a tip cap at an outer radial tip that reduces the clearance between the shroud segments and the rotor blade. Although effective at reducing or preventing leakage around the rotor blades, the interaction between the shroud segments and the tip caps may result in elevated local temperatures that may reduce the low cycle fatigue limits and/or lead to increased creep at the tip caps. As a result, a cooling media may be supplied to flow inside each rotor blade before flowing through cooling passages in the tip cap to provide film cooling over the tip cap of the rotor blade.

In particular designs, each tip cap may include an outer surface or tip plate that is at least partially surrounded by a rim. The rim and the tip plate may at least partially define a tip cavity, also known as a squealer tip cavity, between the rim, the tip plate, and the surrounding shroud segments. In this manner, the cooling media supplied to the squealer tip cavity may remove heat from the tip cap before flowing over the rim and out of the squealer tip cavity. However, excessive cooling media that flows over the suction side of the rotor blade may disrupt the flow of the compressed working fluid over the rotor blades and/or reduce the operating efficiency of the turbine. As a result, an improved rotor blade and a method for cooling the rotor blade would be useful.

BRIEF DESCRIPTION OF THE INVENTION

Aspects and advantages of the invention are set forth below in the following description, or may be obvious from the description, or may be learned through practice of the invention.

One embodiment of the present invention is a rotor blade that includes an airfoil having a tip plate that extends across an outer radial end. A rim extends radially outward from the tip plate and surrounds at least a portion of the airfoil and includes a concave portion opposed to a convex portion. A plurality of dividers extend between the concave and convex portions to define a plurality of pockets between the concave and convex portions at the outer radial end. A plurality of cooling passages through the tip plate provide fluid communication through the tip plate to the plurality of pockets. A first fluid passage in at least one divider provides fluid communication between adjacent pockets across the at least one divider.

Another embodiment of the present invention is a rotor blade that includes an airfoil having a leading edge, a trailing edge downstream from the leading edge, a concave surface between the leading and trailing edges, a convex surface opposed to the concave surface between the leading and trailing edges, and an outer radial end. A tip plate extends across the outer radial end of the airfoil. A concave portion extends radially outward from the concave surface of the airfoil. A convex portion extends radially outward from the convex surface of the airfoil. A plurality of dividers extend between the concave portion and the convex portion to define a plurality of pockets at the outer radial end. A plurality of cooling passages through the tip plate provide fluid communication through the tip plate to the plurality of pockets. A first fluid passage in at least one divider provides fluid communication between adjacent pockets across the at least one divider.

The present invention may also include a turbine that includes a casing and a plurality of airfoils circumferentially arranged inside the casing. Each airfoil has a leading edge, a trailing edge downstream from the leading edge, a concave surface between the leading and trailing edges, a convex surface opposed to the concave surface between the leading and trailing edges, and an outer radial end. A tip plate extends across the outer radial end of each airfoil. A concave portion extends radially outward from the concave surface of each airfoil. A convex portion extends radially outward from the convex surface of each airfoil. A plurality of dividers extend between the concave portion and the convex portion to define a plurality of pockets at the outer radial end. A plurality of cooling passages extend through the tip plate to provide fluid communication through the tip plate to the plurality of pockets. A second fluid passage is in at least one of the concave or convex portions to provide fluid communication across at least one of the concave or convex portions.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
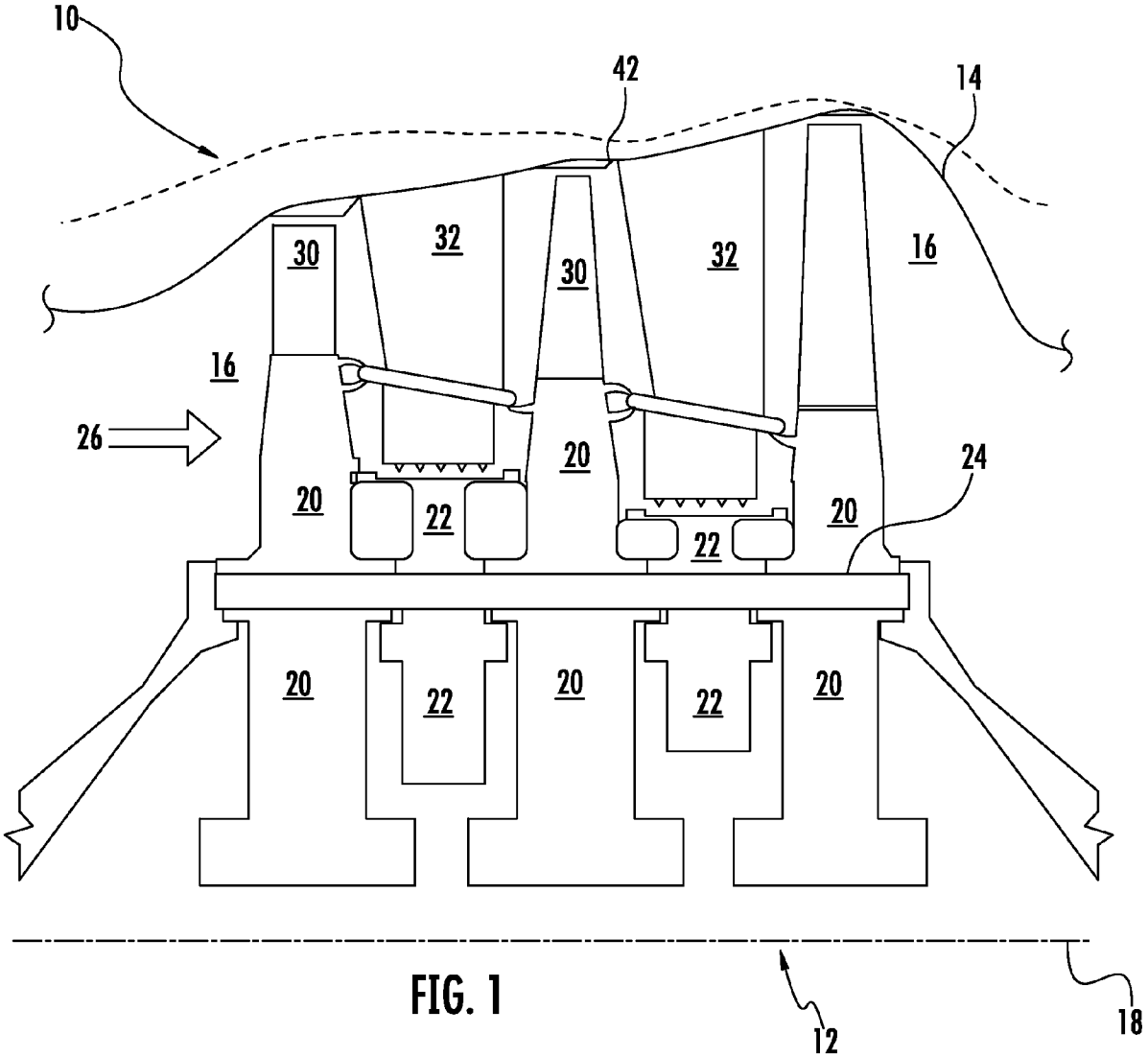
FIG. 1 is a simplified cross-section view of an exemplary turbine that may incorporate various embodiments of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. In addition, the terms "upstream" and "downstream" refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a rotor blade and a method for cooling the rotor blade. The rotor blade generally includes an airfoil with an outer radial end, and a rim extends radially outward from a tip plate at the outer radial end to at least partially define a squealer tip cavity. A plurality of dividers extend across the tip plate to separate the squealer tip cavity into a plurality of pockets, and a plurality of cooling passages provide fluid communication for a cooling media to flow through the tip plate to the plurality of pockets. In particular embodiments, a fluid passage in one or more dividers may provide fluid communication for the cooling media to flow between adjacent pockets. Alternately or in addition, another fluid passage in the rim may provide fluid communication for the cooling media to flow across the rim and out of the pockets. Although exemplary embodiments of the present invention may be described generally in the context of a rotor blade incorporated into a gas turbine or other turbomachine, one of ordinary skill in the art will readily appreciate from the teachings herein that embodiments of the present invention are not limited to a gas turbine or other turbomachine unless specifically recited in the claims.

Referring now to the drawings, wherein identical numerals indicate the same elements throughout the figures, FIG. 1 provides a simplified side cross-section view of an exemplary turbine 10 according to various embodiments of the present invention. As shown in FIG. 1, the turbine 10 generally includes a rotor 12 and a casing 14 that at least partially define a gas path 16 through the turbine 10. The rotor 12 is generally aligned with an axial centerline 18 of the turbine 10 and may be connected to a generator, a compressor, or another machine to produce work. The rotor 12 may include alternating sections of rotor wheels 20 and rotor spacers 22 connected together by a bolt 24 to rotate in unison. The casing 14 circumferentially surrounds at least a portion of the rotor 12 to contain a compressed working fluid 26 flowing through the gas path 16. The compressed working fluid 26 may include, for example, combustion gases, compressed air, saturated steam, unsaturated steam, or a combination thereof.

As shown in FIG. 1, the turbine 10 further includes alternating stages of rotor blades 30 and stator vanes 32 circumferentially arranged inside the casing 14 and around the rotor 12 to extend radially between the rotor 12 and the casing 14. The rotor blades 30 are connected to the rotor wheels 20 using various means known in the art. In contrast, the stator vanes 32 may be peripherally arranged around the inside of the casing 14 opposite from the rotor spacers 22. Each rotor blade 30 and stator vane 32 generally has an airfoil shape, with a concave pressure side, a convex suction side, and leading and trailing edges, as is known in the art. The compressed working fluid 26 flows along the gas path 16 through the turbine 10 from left to right as shown in FIG. 1. As the compressed working fluid 26 passes over the first stage of rotor blades 30, the compressed working fluid 26 expands, causing the rotor blades 30, rotor wheels 20, rotor spacers 22, bolt 24, and rotor 12 to rotate. The compressed working fluid 26 then flows across the next stage of stator vanes 32 which accelerate and redirect the compressed working fluid 26 to the next stage of rotor blades 30, and the process repeats for the following stages. In the exemplary embodiment shown in FIG. 1, the turbine 10 has two stages of stator vanes 32 between three stages of rotor blades 30; however, one of ordinary skill in the art will readily appreciate that the number of stages of rotor blades 30 and stator vanes 32 is not a limitation of the present invention unless specifically recited in the claims.

Figure 2:
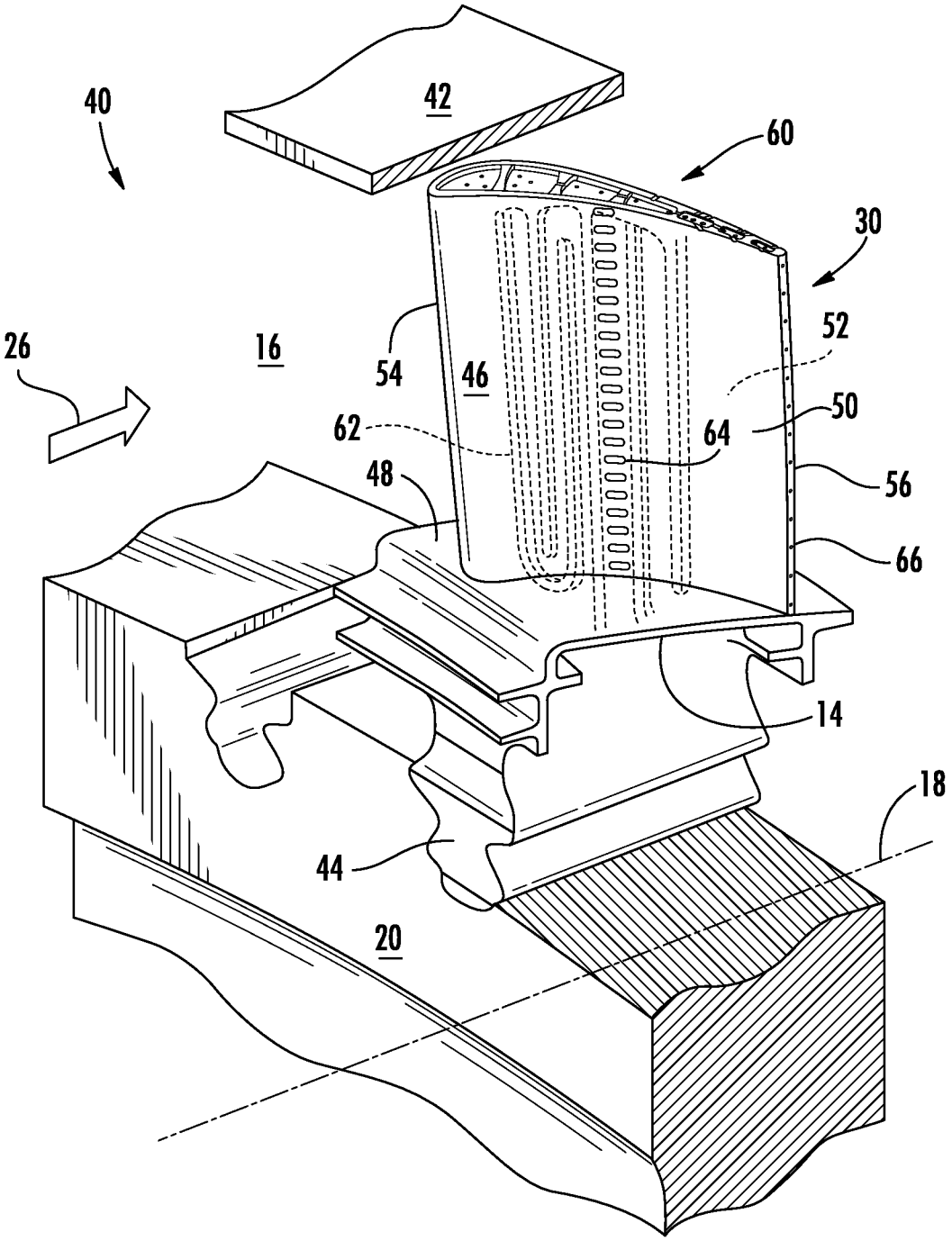
FIG. 2 is a perspective view of a portion of an exemplary turbine stage shown in FIG. 1 within the scope of the present invention.

FIG. 2 provides a perspective view of a portion of an exemplary stage 40 of rotor blades 30 shown in FIG. 1 within the scope of the present invention. The stage 40 may be any stage in the turbine 10 downstream from a steam generator, combustor, or other system (not shown) that generates the compressed working fluid 26. As shown in FIGS. 1 and 2, an annular shroud 42 or plurality of shroud segments may be suitably joined to the casing 14 (not shown in FIG. 2) and surrounds the rotor blades 30 to provide a relatively small clearance or gap therebetween to limit leakage of the compressed working fluid 26 therethrough during operation. Each rotor blade 30 generally includes a dovetail 44 which may have any conventional form, such as an axial dovetail configured to slide in a corresponding dovetail slot in the perimeter of the rotor wheel 20. A hollow airfoil 46 may be integrally joined to the dovetail 44 and may extend radially or longitudinally outwardly therefrom. The rotor blade 30 may also include an integral platform 48 disposed at the junction of the airfoil 46 and the dovetail 48 for defining a radially inner portion of the compressed working fluid 26 flow path. It will be appreciated that the rotor blade 30 may be formed in any conventional manner and may be a single or multi-piece casting.

The airfoil 46 generally includes a concave pressure surface 50 and a circumferentially or laterally opposite convex suction surface 52 that extend axially between a leading edge 54 and a trailing edge 56. The pressure and suction surfaces 50, 52 also extend in the radial direction between a radially inner root 58 at the platform 48 and an outer radial end 60, which will be described in more detail in the discussion related to FIGS. 3-5. Further, the pressure and suction surfaces 50, 52 are spaced apart in the circumferential direction over the entire radial span of the airfoil 46 to define at least one internal flow chamber, channel, or cavity 62 for flowing a cooling media through the airfoil 46. The cooling media may include any fluid suitable for removing heat from the rotor blade 30, including, for example, saturated steam, unsaturated steam, or air. The cavity 62 may have any configuration, including, for example, serpentine flow channels with various turbulators therein for enhancing cooling media effectiveness, and the cooling media may be discharged through various holes through the airfoil 46, such as conventional film cooling holes 64 and/or trailing edge discharge holes 66.

Figure 3:
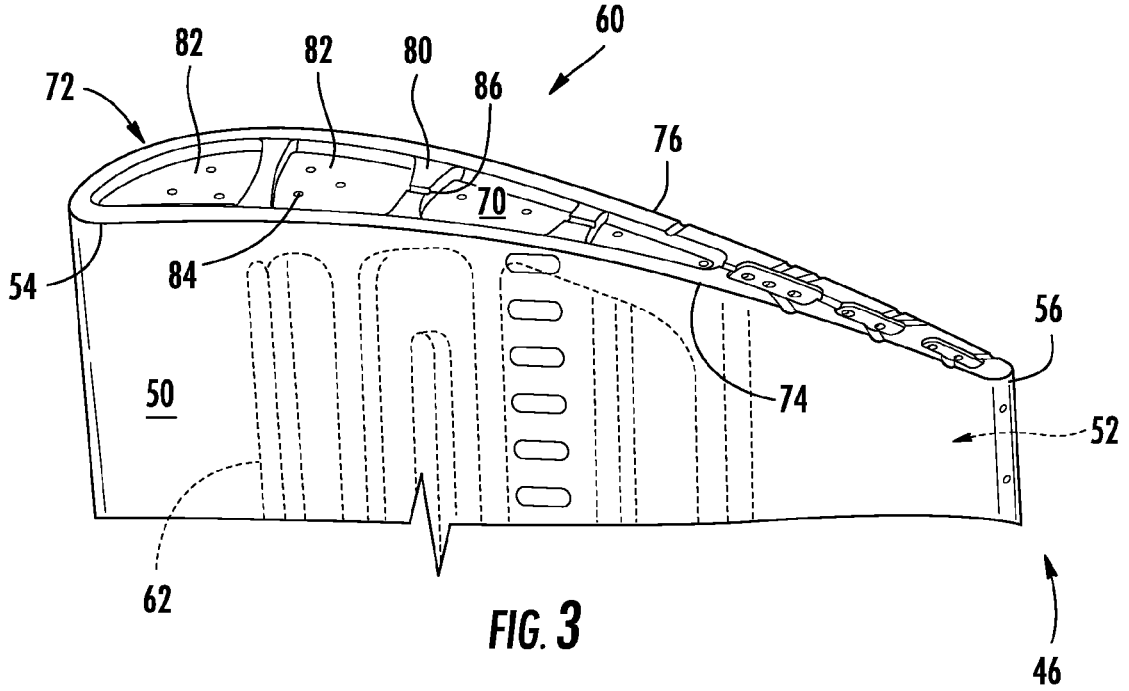
FIG. 3 is an enlarged partial perspective view of the rotor blade shown in FIG. 2 according to one embodiment of the present invention.
Figure 4:
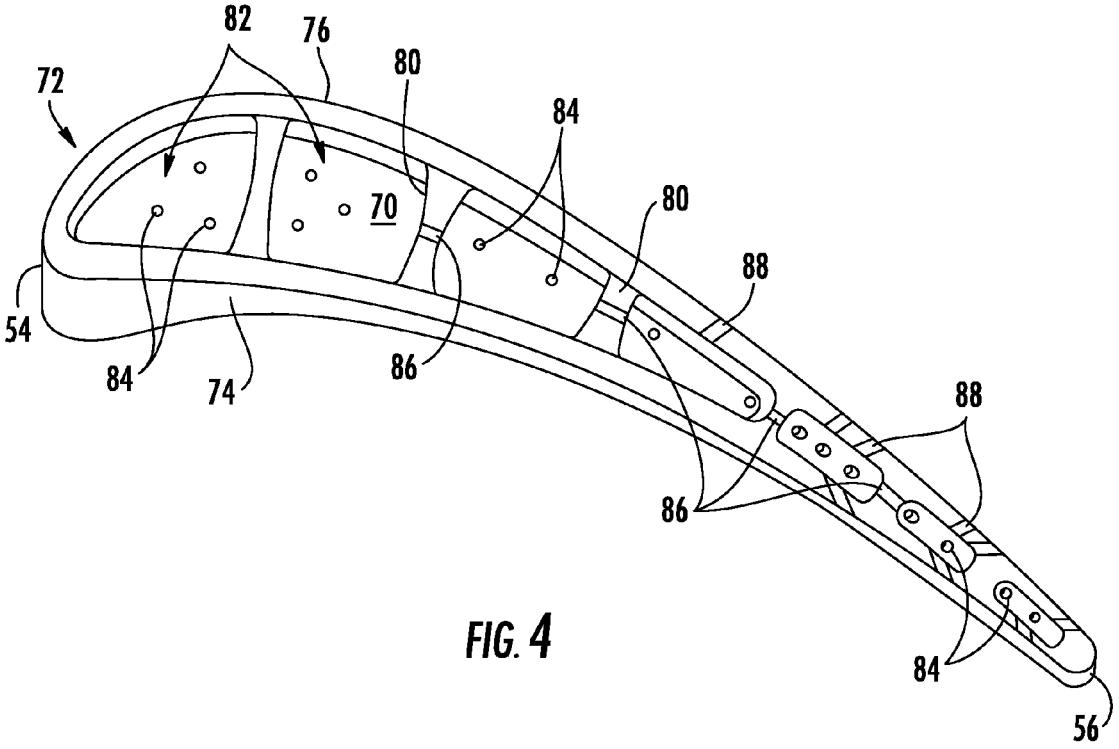
FIG. 4 is a top plan view of the outer radial end of the rotor blade shown in FIG. 2 according to one embodiment of the present invention.
Figure 5:
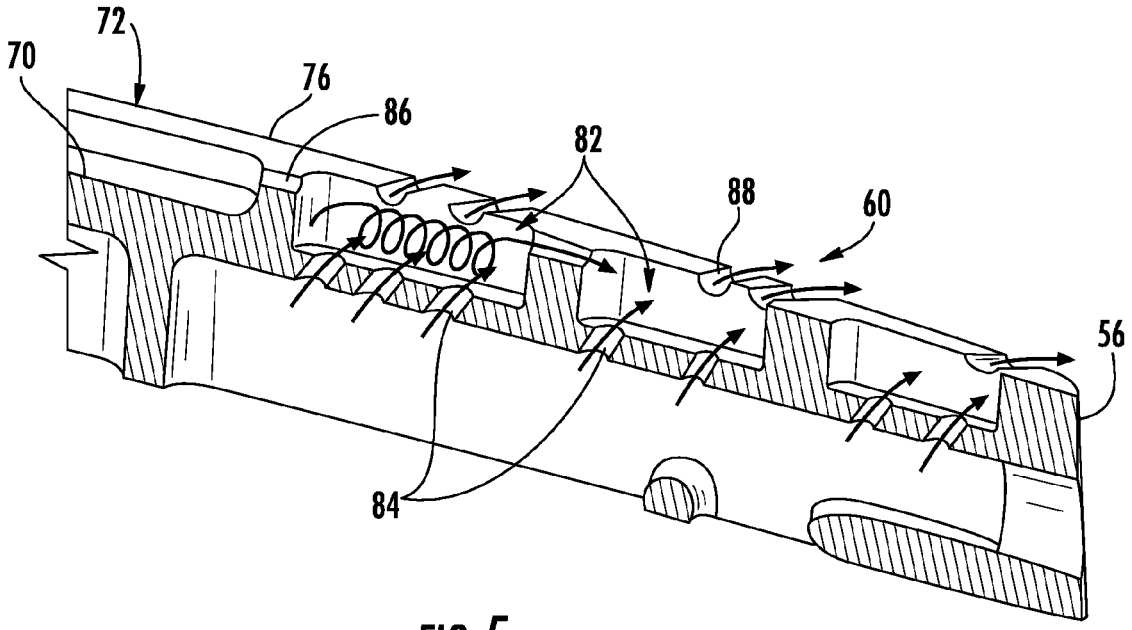
FIG. 5 is a cross-section view of a portion of the outer radial end of the rotor blade shown in FIG. 4.

FIGS. 3-5 provide an enlarged partial perspective view, top plan view, and cross-section view of the outer radial end 60 of the airfoil 46 shown in FIG. 2 according to one embodiment of the present invention. As shown in FIGS. 3-5, a tip plate 70 may extend across the outer radial end 60. The tip plate 70 may be integral to the rotor blade 30 or may be welded into place at the outer radial end 60 of the airfoil 46. A rim 72 extends radially outward from the tip plate 70 to surround at least a portion of the airfoil 46. The rim 72 may include a concave portion 74 opposed to a convex portion 76. The concave portion 74 extends radially outward from the concave surface 50 of the airfoil 46, and the convex portion 76 extends radially outward from the convex surface 52 of the airfoil 46. Generally, the concave and convex portions 74, 76 will intersect with the tip plate 70 at approximately right angles, but this may vary in particular embodiments. In addition, the concave and convex portions 74, 76 may have approximately rectangular cross-sections, and the height and width of the concave and convex portions 74, 76 may vary around the tip plate 70, depending on various factors such as the location of the rotor blade, desired clearance with the shroud 42, etc. In particular embodiments, the concave and convex portions 74, 76 may join at the leading and trailing edges 54, 56 so that rim 42 surrounds the entire tip plate 70, as shown most clearly in FIGS. 3 and 4.

As further shown in FIGS. 3-5, a plurality of dividers 80 may extend across the tip plate 70 between the concave and convex portions 74, 76 to define a plurality of pockets 82 in the squealer tip cavity between the concave and convex portions 74, 76 at the outer radial end 60. Each pocket 82 may be generally bound by one or more dividers 80, the concave and convex portions 74, 76, and the tip plate 70. In addition, the pockets 82 are generally open through the outer radial end 60 of the rotor blade 30, and, upon installation, essentially become enclosed by the surrounding shroud 42.

The pockets 82 may vary in width, depth, length, and/or volume, particularly in the direction of the trailing edge 56; however, the present invention is not limited to any particular shape, size, or orientation of the pockets 82 unless specifically recited in the claims. As seen most clearly in FIGS. 4 and 5, for example, the depth of the pockets 82 may be substantially constant across the tip plate 70, while the width of the pockets 82 may decrease in the direction of the trailing edge 56. In such cases, the width of the pockets 82 generally narrows in proportion to the narrowing shape of the airfoil 46 toward the trailing edge 56.

In particular embodiments, the tip plate 70, rim 72, and/or dividers 80 may be treated with a coating, such as a bond coat or other type of high-temperature coating. The coating may include, for example, a corrosion inhibitor with a high aluminum content, such as an aluminide coating. Aluminide coatings are highly effective against corrosion, but tend to wear quickly. As a result, aluminide coatings are well-suited for the interior of the pockets 82 because this location is relatively sheltered from rubbing against adjacent parts.

The rotor blade 30 may further include a plurality of cooling passages 84 that provide fluid communication through the tip plate 70 to the individual pockets 82. The size and number of cooling passages 84 in each pocket 82 is selected to deliver the desired pressure and flow rate of cooling media from the cavity 62 inside the airfoil 46 and into the pockets 82. As one of ordinary skill in the art will appreciate, the differential pressure across the airfoil 46 tends to sweep the cooling media over the convex portion 76 of the rim 72 and out of the pockets 82. Cooling media lost in this manner not only reduces the cooling provided to the outer radial end 60, but it also negatively impacts the efficiency of the turbine 10. As a result, the rotor blade 30 may further include fluid passages 86 in the dividers 80 and/or fluid passages 88 in the rim 72 to enhance distribution and/or flow of the cooling media between adjacent pockets 82. The cooling media may thus flow through the cooling passages 84 and into the individual pockets 82 to convectively and conductively cool the tip plate 70, rim 72, and dividers 80 while also partially insulating these surfaces from the extreme temperatures associated with the compressed working fluid 26 flowing through the gas path 16. In addition, the cooling media may flow through the fluid passages 86 in the dividers 80 to provide additional cooling to adjacent pockets 82 before flowing out of the pockets 82 through the fluid passages 88 in the rim 72. In this manner, the outer radial end 60 of the rotor blade 30 may be maintained at an acceptable temperature during operation without increasing the flow rate of cooling media through the pockets 82. Further, as one of ordinary skill in the art will appreciate, the resulting decrease in temperatures generally reduces the amount of oxidation that occurs during operation along outer radial end 60 of the rotor blade 30. The reduction in oxidation improves the aerodynamic performance of the airfoil 46 and, ultimately, reduces repair costs. In addition, the cooling media flow over the rim 72 acts as a seal across that portion of the rotor blade 30 to reduce the amount of compressed working fluid 26 that might otherwise bypass the rotor blade 30, further improving turbine 10 performance.

Figure 6:
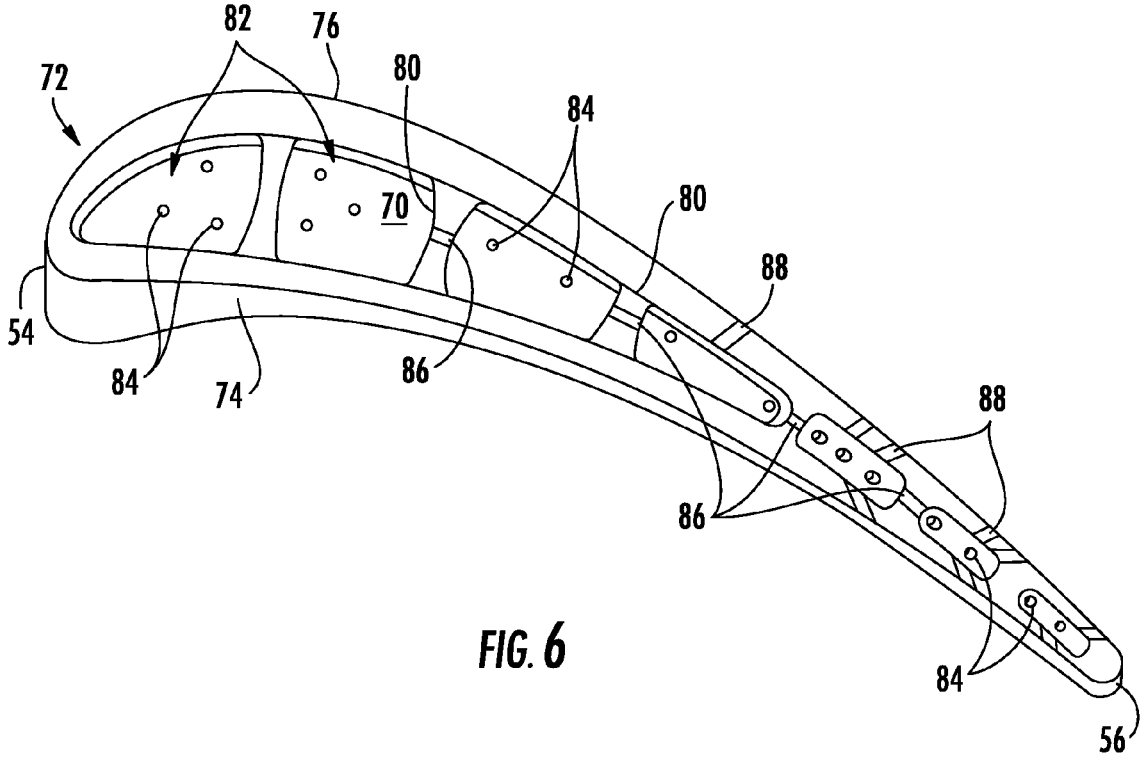
FIG. 6 is a top plan view of the outer radial end of the rotor blade shown in FIG. 2 according to an alternate embodiment of the present invention.
Figure 7:
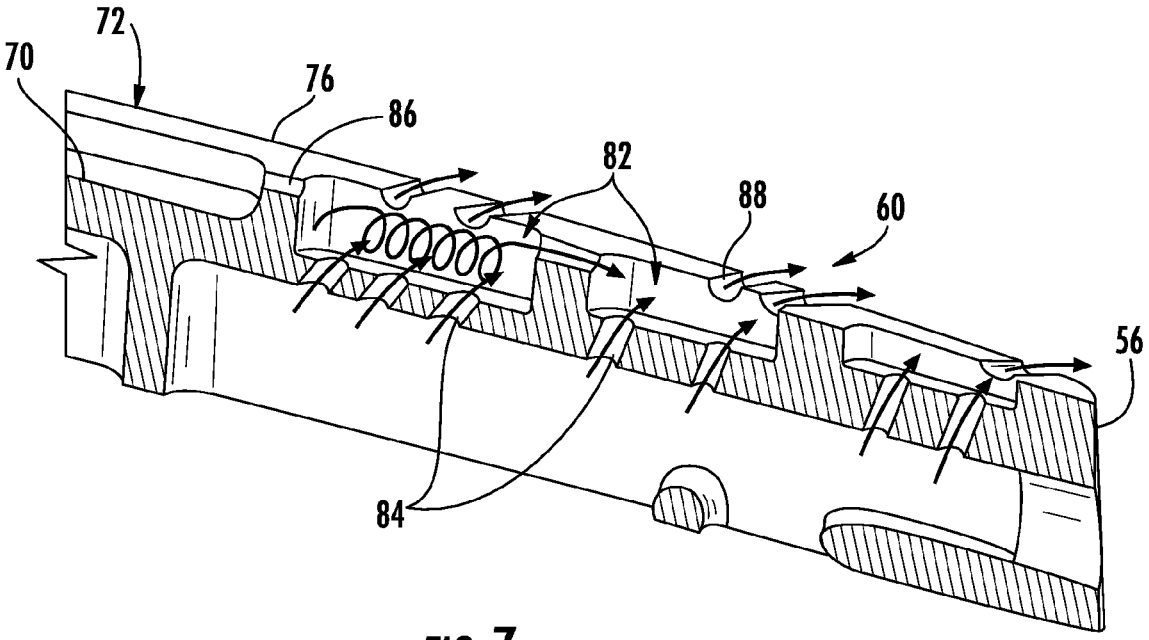
FIG. 7 is a cross-section view of a portion of the outer radial end of the rotor blade shown in FIG. 6.

FIGS. 6 and 7 provide top plan and cross-section views of the outer radial end 60 of the rotor blade 30 according to an alternate embodiment of the present invention. The rotor blade 30 generally includes the airfoil 46, outer radial end 60, tip plate 70, rim 72, dividers 80, pockets 82, cooling passages 84, and fluid passages 86, 88 as previously described with respect to FIGS. 3-5. In this particular embodiment, the convex portion 76 of the rim 72 has a larger width than the concave portion 74 of the rim 72, particularly away from the trailing edge 56. As a result, the cooling media is less likely to prematurely leak over the concave portion 74 of the rim 72 before providing the desired cooling to the outer radial end 60 of the rotor blade 30. In addition, the depth of the pockets 82 may gradually decrease in the direction of the trailing edge 56. The decrease in depth of the pockets 82 near the trailing edge 56 reduces the residence time of the cooling media in the pockets 82 before leaking across the rim 72 to further enhance cooling to the outer radial end 60 of the rotor blade.

One of ordinary skill in the art will readily appreciate from the teachings herein that the embodiments shown and described with respect to FIGS. 1-7 may also provide a method for cooling the rotor blade 30. The method may include, for example, flowing the cooling media through the cooling passages 84 and into the pockets 82 defined by the tip plate 70, rim 72, and/or dividers 80. The method may further include flowing the cooling media between adjacent pockets 82 by flowing the cooling media through the fluid passages 86 in the dividers 80. Alternately or in addition, the method may include flowing the cooling media out of the pockets 82 by flowing the cooling media through the fluid passages 88 in the concave and/or convex portions 74, 76 of the rim 42.

It is anticipated that the various embodiments shown and described in FIGS. 1-7 will enhance cooling to the outer radial end 60 of the rotor blade 30 while also reducing the amount of cooling media that flows over the rim 72 and into the hot gas path 16. As a result, the embodiments described herein will reduce the temperatures of the rotor blade 30, especially around the outer radial end 60, thereby improving the low cycle fatigue limits for these components and reducing localized creep due to excessive temperatures.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A rotor blade, comprising:

a. an airfoil having a tip plate that extends across an outer radial end;

b. a rim that extends radially outward from the tip plate, wherein the rim surrounds at least a portion of the airfoil and includes a concave portion opposed to a convex portion;

c. a plurality of dividers that extend between the concave and convex portions radially outwardly from an outer surface of the tip plate to define a plurality of pockets between the concave and convex portions at the outer radial end;

d. a plurality of cooling passages through the outer surface of the tip plate, wherein the plurality of cooling passages provide fluid communication through the tip plate to the plurality of pockets; and e. a first fluid passage in at least one divider, wherein the fluid passage extends in a chamberwise direction and is radially offset from the tip plate, wherein the first fluid passage provides fluid communication between adjacent pockets across the at least one divider.

2. The rotor blade as in claim 1, further comprising a second fluid passage in at least one of the concave or convex portions, wherein the second fluid passage provides fluid communication across at least one of the concave or convex portions.

3. The rotor blade as in claim 1, further comprising a second fluid passage in both of the concave and convex portions, wherein the second fluid passage provides fluid communication across both of the concave and convex portions.

4. The rotor blade as in claim 1, wherein the convex portion has a larger width than the concave portion.

5. The rotor blade as in claim 1, wherein the airfoil has a trailing edge and at least one pocket has a depth that increases toward the trailing edge.

6. The rotor blade as in claim 1, wherein the airfoil has a trailing edge and the plurality of pockets decrease in volume toward the trailing edge.

7. A rotor blade, comprising:

a. an airfoil having a leading edge, a trailing edge downstream from the leading edge, a concave surface between the leading and trailing edges, a convex surface opposed to the concave surface between the leading and trailing edges, and an outer radial end;

b. a tip plate that extends across the outer radial end of the airfoil;

c. a concave portion that extends radially outwardly from the tip plate along the concave surface of the airfoil;

d. a convex portion that extends radially outwardly from the tip plate along the convex surface of the airfoil;

e. a plurality of dividers that extend radially outwardly from an outer surface of the tip plate between the concave portion and the convex portion to define a plurality of pockets at the outer radial end;

f. a plurality of cooling passages that extend through the outer surface of the tip plate, wherein the plurality of cooling passages provide fluid communication through the tip plate to the plurality of pockets; and g. a first fluid passage in at least one divider, wherein the fluid passage extends in a chamberwise direction and is radially offset from the tip plate, wherein the first fluid passage provides fluid communication between adjacent pockets across the at least one divider.

8. The rotor blade as in claim 7, further comprising a second fluid passage in at least one of the concave or convex portions, wherein the second fluid passage provides fluid communication across at least one of the concave or convex portions.

9. The rotor blade as in claim 7, further comprising a second fluid passage in both of the concave and convex portions, wherein the second fluid passage provides fluid communication across both of the concave and convex portions.

10. The rotor blade as in claim 7, wherein the convex portion has a larger width than the concave portion.

11. The rotor blade as in claim 7, wherein at least one pocket has a depth that increases toward the trailing edge.

12. The rotor blade as in claim 7, wherein the plurality of pockets decrease in volume toward the trailing edge.

13. A turbine, comprising:

a. a casing;

b. a plurality of airfoils circumferentially arranged inside the casing, wherein each airfoil has a leading edge, a trailing edge downstream from the leading edge, a concave surface between the leading and trailing edges, a convex surface opposed to the concave surface between the leading and trailing edges, and an outer radial end;

c. a tip plate that extends across the outer radial end of each airfoil;

d. a concave portion that extends radially outwardly from the tip plate along the concave surface of each airfoil;

e. a convex portion that extends radially outwardly from the tip plate along the convex surface of each airfoil;

f. a plurality of dividers that extend radially outwardly from an outer surface of the tip plate between the concave portion and the convex portion to define a plurality of pockets at the outer radial end;

g. a plurality of cooling passages through the outer surface of the tip plate, wherein the plurality of cooling passages provide fluid communication through the tip plate to the plurality of pockets;

h. a first fluid passage in at least one divider, wherein the fluid passage extends in a chamberwise direction and is radially offset from the tip plate, wherein the first fluid passage provides fluid communication between adjacent pockets across the at least one divider; and i. a second fluid passage in at least one of the concave or convex portions, wherein the second fluid passage provides fluid communication across at least one of the concave or convex portions.

14. The turbine as in claim 13, wherein the second fluid passage is in both of the concave and convex portions, wherein the second fluid passage provides fluid communication across both of the concave and convex portions.

15. The turbine as in claim 13, wherein the convex portion has a larger width than the concave portion.

16. The turbine as in claim 13, wherein at least one pocket has a depth that increases toward the trailing edge.

17. The turbine as in claim 13, wherein the plurality of pockets decrease in size toward the trailing edge.

* * * * *